US010706867B1

(12) United States Patent
Villavicencio et al.

(10) Patent No.: US 10,706,867 B1
(45) Date of Patent: Jul. 7, 2020

(54) GLOBAL FREQUENCY-WARPING TRANSFORMATION ESTIMATION FOR VOICE TIMBRE APPROXIMATION

(71) Applicants: Fernando Villavicencio, South Pasadena, CA (US); Mark Harvilla, Pasadena, CA (US)

(72) Inventors: Fernando Villavicencio, South Pasadena, CA (US); Mark Harvilla, Pasadena, CA (US)

(73) Assignee: OBEN, INC., Pasadena, CA (US)

( * ) Notice: Subject to any disclaimer, the term of this patent is extended or adjusted under 35 U.S.C. 154(b) by 177 days.

(21) Appl. No.: 15/912,253

(22) Filed: Mar. 5, 2018

Related U.S. Application Data

(60) Provisional application No. 62/466,957, filed on Mar. 3, 2017.

(51) Int. Cl.

| | |
|---|---|
| ***G10L 21/013*** | (2013.01) |
| ***G10L 25/21*** | (2013.01) |
| ***G10L 25/24*** | (2013.01) |
| ***G10L 25/75*** | (2013.01) |

(52) U.S. Cl.
CPC ..... *G10L 21/013* (2013.01); *G10L 25/21* (2013.01); *G10L 25/24* (2013.01); *G10L 25/75* (2013.01); *G10L 2021/0135* (2013.01)

(58) Field of Classification Search
CPC ..... G10L 13/00; G10L 19/04; G10L 13/02; G10L 17/00; G10L 21/00
USPC ..... 704/205, 246, 267, 269, 219, 268
See application file for complete search history.

(56) References Cited

U.S. PATENT DOCUMENTS

| | | | | |
|---|---|---|---|---|
| 5,327,521 | A * | 7/1994 | Savic | G10L 21/00 704/200 |
| 9,343,060 | B2 * | 5/2016 | Villavicencio | G10L 13/033 |
| 2001/0021904 | A1 * | 9/2001 | Plumpe | G10L 19/06 704/209 |
| 2002/0065649 | A1 * | 5/2002 | Kim | G10L 19/08 704/219 |
| 2006/0259303 | A1 * | 11/2006 | Bakis | G10L 13/10 704/268 |
| 2007/0027687 | A1 * | 2/2007 | Turk | G10L 21/00 704/246 |
| 2007/0208566 | A1 * | 9/2007 | En-Najjary | G10L 13/033 704/269 |
| 2009/0171657 | A1 * | 7/2009 | Tian | G10L 21/00 704/219 |

(Continued)

*Primary Examiner* — Akwasi M Sarpong
(74) *Attorney, Agent, or Firm* — Andrew S. Naglestad

(57) ABSTRACT

A method and system for converting a source voice to a target voice is disclosed. The method comprises: recording source voice data and target voice data; extracting spectral envelope features from the source voice data and target voice data; time-aligning pairs of frames based on the extracted spectral envelope features; converting each pair of frames into a frequency domain; generating a plurality of frequency-warping factor candidates, wherein each of the plurality of frequency-warping factor candidates is associated with one of the pairs of frames; generating a single global frequency-warping factor based on the candidates; acquiring source speech; converting the source speech to target speech based on the global frequency-warping factor; generating a waveform comprising the target speech; and playing the waveform comprising the target speech to a user.

6 Claims, 3 Drawing Sheets

(56) References Cited

U.S. PATENT DOCUMENTS

| | | | | |
|---|---|---|---|---|
| 2012/0095767 | A1* | 4/2012 | Hirose | G10L 13/033 704/258 |
| 2013/0166286 | A1* | 6/2013 | Matsumoto | G10L 21/02 704/205 |
| 2014/0053709 | A1* | 2/2014 | Sauerwein | G06F 1/0321 84/603 |
| 2014/0280265 | A1* | 9/2014 | Wang | H04L 67/42 707/758 |
| 2015/0025892 | A1* | 1/2015 | Lee | G10L 21/003 704/267 |

* cited by examiner

GLOBAL FREQUENCY-WARPING TRANSFORMATION ESTIMATION FOR VOICE TIMBRE APPROXIMATION

CROSS-REFERENCE TO RELATED APPLICATION(S)

This application claims the benefit of U.S. Provisional Patent Application Ser. No. 62/466,957 filed Mar. 3, 2017, titled "Global frequency-warping transformation estimation for voice timbre approximation," which is hereby incorporated by reference herein for all purposes.

TECHNICAL FIELD

The invention generally relates to the field of voice conversion. In particular, the invention relates to a system and method for converting a source voice to a target voice based on a plurality of frequency-warping factors.

BACKGROUND

One of the current challenges in speech technology is the transform of speech of one individual so that it sounds like the voice of another individual. This task is commonly referred to as voice conversion (VC). The main challenge in voice conversion is the transformation of the acoustic properties of the voice that form the basis of perceptual discrimination and identification of an individual. The voice height (pitch), for example, is believed to provide the main perceptual clue to discriminate between different speakers, while the way of speaking (e.g. prosody) and the timbre of the voice are important to identification of a particular individual's voice.

The prosody can be briefly described as the way in which the pitch of the voice progresses at a segmental (i.e. phrase) and supra-segmental levels. Most of the current voice conversion strategies do not process prosodic or short-term pitch information and focus, instead, on matching the overall pitch statistics (mean and variance) of the "source" voice to those of the "target" voice.

Voice timbre is generally based on the human vocal system, particularly the shape and length of the vocal tract. Vocal track length differs widely across individuals of different genders and ages. By modifying the speech waveform spectra to reflect differences in voice timbre, it is possible to transform the perceived identity, gender, or age of the voice.

The techniques for altering the vocal track length conditions of one voice to another are commonly referred to as Vocal-Tract Length Normalization (VTLN). Typically, these VTLN techniques estimate a frequency-warping based function that better matches the frequency axis of the source voice to that of the target voice. VTLN may be applied to map the timbre as the first step during Voice Conversion. Although the resulting sound quality may be artifact-free, VTLN does not generally lead to a close perception of the timbre of the target voice.

Determination of a frequency-warping based transformation that leads to a convincing VTLN perceived effect is challenging for multiple reasons. Firstly, it's difficult to define a convenient correspondence of the features between source and target spectra. Secondly, it is difficult to ensure a convenient progression over time if the transformation is updated on a short-term basis. There is therefore a need for a voice conversion technique that maps features between source and target spectra in a manner that accurately accounts for differences in timbre between the source and target voices.

SUMMARY

The invention features a method and system for converting a source voice to a target voice. The method comprises: recording source voice data and target voice data; extracting spectral envelope features from the source voice data and target voice data; time-aligning pairs of frames of source and target voice data based on the extracted spectral envelope features; converting each pair of frames into a frequency domain; generating a plurality of frequency-warping factor candidates, wherein each of the plurality of frequency-warping factor candidates is associated with one of the pairs of frames; generating a single global frequency-warping factor based on the candidates; acquiring source speech; converting the source speech to target speech based on the global frequency-warping factor, generating a waveform comprising the target speech; and playing the waveform comprising the target speech to a user.

In the preferred embodiment, the step of generating a plurality of frequency-warping factor candidates comprises: for each pair of frames, identifying a frequency-warping factor candidate that minimizes a matching error between a spectrum of a source frame and a frequency-warped spectrum of a target frame; generating a histogram of frequency-warping factor candidates; identifying three peaks including a maximal peak in the histogram of frequency-warping factor candidates; retaining frequency-warping factor candidates corresponding to the maximal peak in the histogram while removing frequency-warping factor candidates corresponding to the remaining two peaks in the histogram; and generating the global frequency-warping factor based on the plurality of frequency-warping factor candidates corresponding to the maximal peak in the histogram.

BRIEF DESCRIPTION OF THE DRAWINGS

The present invention is illustrated by way of example and not limitation in the figures of the accompanying drawings, and in which.

DETAILED DESCRIPTION OF THE PREFERRED EMBODIMENT

The preferred embodiment of the present invention is configured to convert source speech to target speech. The target speech is an audio file or stream that retains the speech spoken by a source speaker, but converts the pitch and speech patterns to that of a target speaker. As such, the voice conversion effectively produces audio data that sounds as though the individual associated with the target is speaking the same words spoken by the individual associated with the source voice and at the same prosody and cadence as the source voice.

Figure 1:
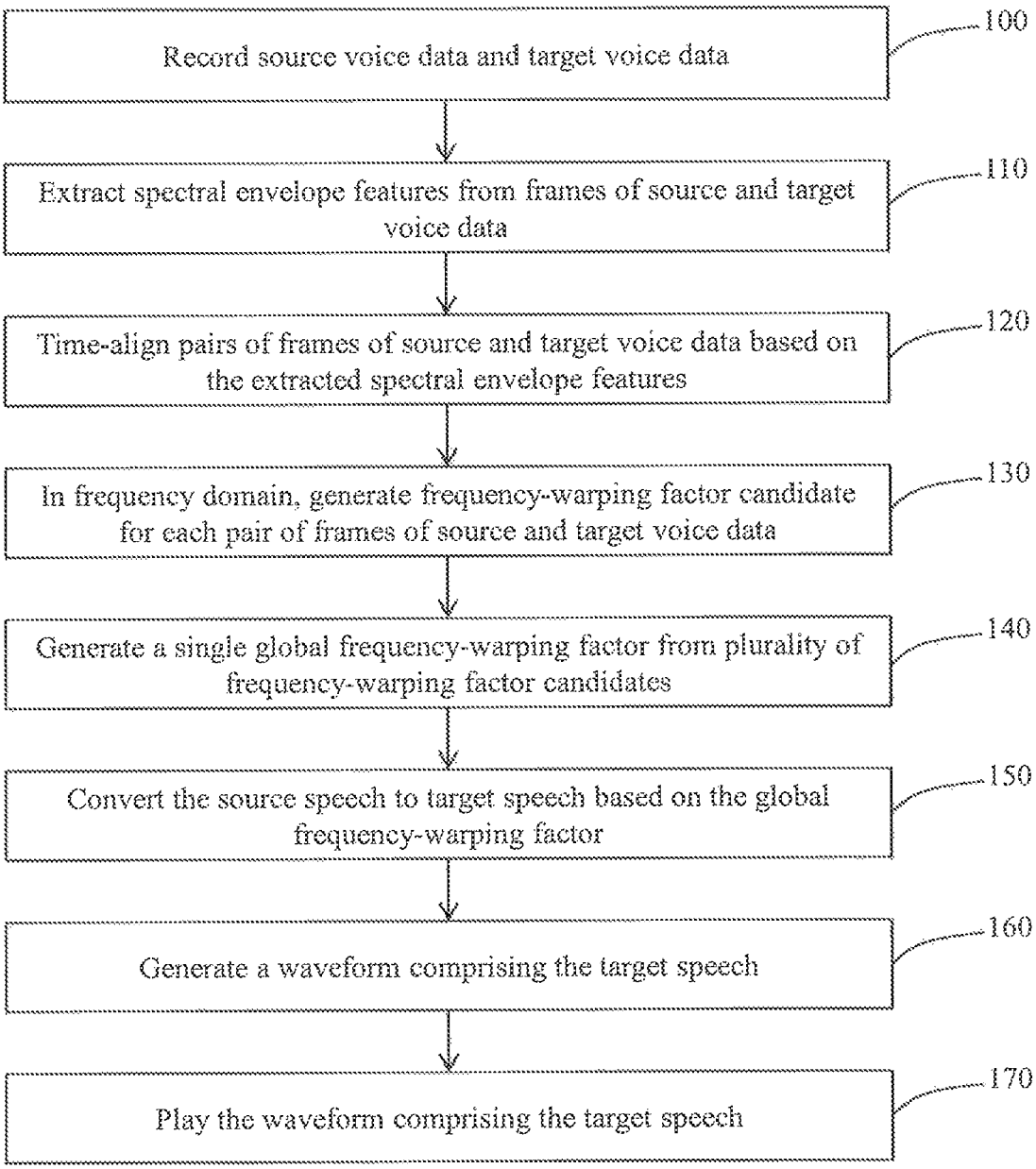
FIG. 1 is a flowchart of the process for converting a source voice to a target voice, in accordance with a preferred embodiment of the present invention.

Illustrated in FIG. 1 is the method of converting a source speech into target speech. The audio data of a source speaker, referred to here as the source voice data, is first recorded 100 and provided as input to the voice conversion system (VCS) of the present invention. The audio data of a target speaker, referred to here as the target voice data, is also recorded and provided as input to the VCS.

I. Extraction of the Short-Term Spectral Envelope Information

As a first step, the voice conversion parses or segments the source voice data and target voice data into audio segments or frames. Each frame is characterized by a window length and an overlap with the adjacent frames.

In particular, for each voice data set, the speech signal s[n] is segmented into a plurality of overlapping frames for short-time processing. The shift rate, preferably 5 milliseconds, and the length of the analysis window, preferably 25 milliseconds, determine which samples of the signal are processed into segments given by a frame index, m.

Each frame m is processed to determine if the audio of the frame includes a person speaking, referred to as a voiced frame, or whether the frame is unvoiced. The frame is labeled as "voiced" if the waveform exhibits periodicity related to the pitch. A binary flag p denoting the voicing decision (1 if voiced, 0 otherwise) is stored.

The spectral envelope of each frame is then estimated 110. In the preferred embodiment, the envelope is represented in terms of audio features, preferably Mel-Frequency Cepstral Coefficients or other spectral envelope representation. The sequence of Mel-Frequency Cepstral Coefficients for each frame are represented by feature vector V and stored for further processing.

The process repeats for each frame m until it reaches the end of the signal s[n]. The vectors V and flags p for all the utterances are stored sequentially in matrix X for the source voice data and in matrix Y for target voice data.

II. Time-Domain Alignment

Dynamic Time Warping is then applied for time-alignment 120 of the feature vectors V contained in matrices X and Y. The elements of matrix X (source voice data) are aligned to matrix Y (target voice data) and stored in matrix $X_a$ accordingly. The purpose of alignment is to identify pairs of spectra that represent the same information in the phonetic sequences in both the source voice data and target voice data based on the similarity of the spectral envelopes.

Next, the VCS of the preferred embodiment removes feature vectors from both $X_a$ and Y if either feature vector of a time-aligned pair of feature vectors corresponds to an unvoiced frame. Letting k be the index of each feature vector of matrix $X_a$ and Y (k=1, 2, . . . K), the VCS removes the feature vector from $X_a$ and Y of corresponding index k unless both frames are labeled as voiced according to their flag P. The new matrices containing voiced-only feature vectors from $X_a$ and Y are denoted as $X_{av}$ and $Y_v$, respectively.

III. Frame-Wise Frequency-Warping Factor Estimation

The VCS of the preferred embodiment then computes a plurality of estimates of a conversion factor for converting source voice data to target voice data. Each of the estimates is referred to herein as a frequency-warping factor candidate. A large number of frequency-warping factor candidates are computed 130 and a single global frequency-warping factor computed 140 from the plurality of frequency-warping factor candidates.

As a first step to calculating the frequency-warping factor candidates, the VCS removes or otherwise filters feature vectors that are unreliable due to low energy data, for example. To calculate the energy and remove the low energy data, the VCS generates a multiplication between the first cepstral dimension (indicative of energy) of feature vectors of the same index of matrices $X_{av}$ and $Y_v$ and store the results in vector E. Higher values on E denote waveforms of low energy, while lower values of E denote waveforms of higher energy.

Based on an energy threshold, pairs of feature vectors are removed from consideration. In the preferred embodiment, the energy threshold $E_{min}$ is computed as follows:

$$E_{tr}=\text{mean}(E)+\text{std}(E)$$

The VCS then remove all the pairs of feature vectors on matrices $X_{av}$ and $Y_v$ of index k according to the elements on vector E with value higher than $E_{tr}$. This procedure removes pairs of feature vectors denoting waveforms of low energy according to $E_{tr}$.

The VCS then generates the spectral envelopes from the feature vectors to produce a frequency-domain representation of the voice data. In particular, the VCS applies a Fourier Transform to compute log-spectrum feature vectors U of size N of features vectors V in matrices $X_{av}$ and $Y_v$ and store them on matrices $S_{xa}$, and $S_y$ respectively.

A frequency-warping function may then be employed to convert spectra of the source speech to spectra of target speech. In the preferred embodiment, the frequency warping function $f_\alpha(\omega)$ is defined as follows:

$$f_\alpha(\omega) = \pi_{fs}\left(\frac{\omega}{\pi_{fs}}\right)^\alpha, \text{ for } \omega \in [0, \pi)$$

where ω denotes the values of the bins of the linear frequency axis of feature vector U; $\pi_{fs}$ denotes the limit in the frequency domain corresponding to half the sample rate fs, and a the frame-wise frequency-warping factor.

A spectral matching error function $J_k(\alpha)$ is then employed to estimate an error or cost associated of a match between the spectrum of the source and target speech for a given frequency-warping factor candidate. The cost function is defined as follows:

$$J_k(\alpha) = \sum_{\omega=0}^{\omega=\omega_c} (Ux_{f\alpha(\omega),k} - Uy_{\omega,k})^2$$

where $Uy_{\omega,k}$ corresponds to feature vector of index k in $S_y$ and $Ux_{f\alpha(\omega),k}$ the frequency-warped version of feature vector of index k in $S_{xa}$. Note that $J_k(\alpha)$ is limited to the information on $Uy_{\omega,k}$ and $Ux_{f\alpha(\omega),k}$ within the frequency range=$[0,\omega_c]$. In the preferred embodiment, $\omega_c$ is set to 5 kHz.

For each pair of frames of source and target speech data, the VCS selects a frequency-warping factor candidate that minimizes the matching error for each pair of frames. A global frequency warping factor is then generated 140 from the plurality of frequency-warping factor candidates. This global frequency warping factor is then used 150 for subsequent conversion of the source speech to the target speech on a frame-by-frame basis. The frames of target speech may be assembled 160 into a waveform and the audio played 170 to a user on their mobile phone, for example.

IV. Estimation of a Global Frequency-Warping Factor

Figure 2:
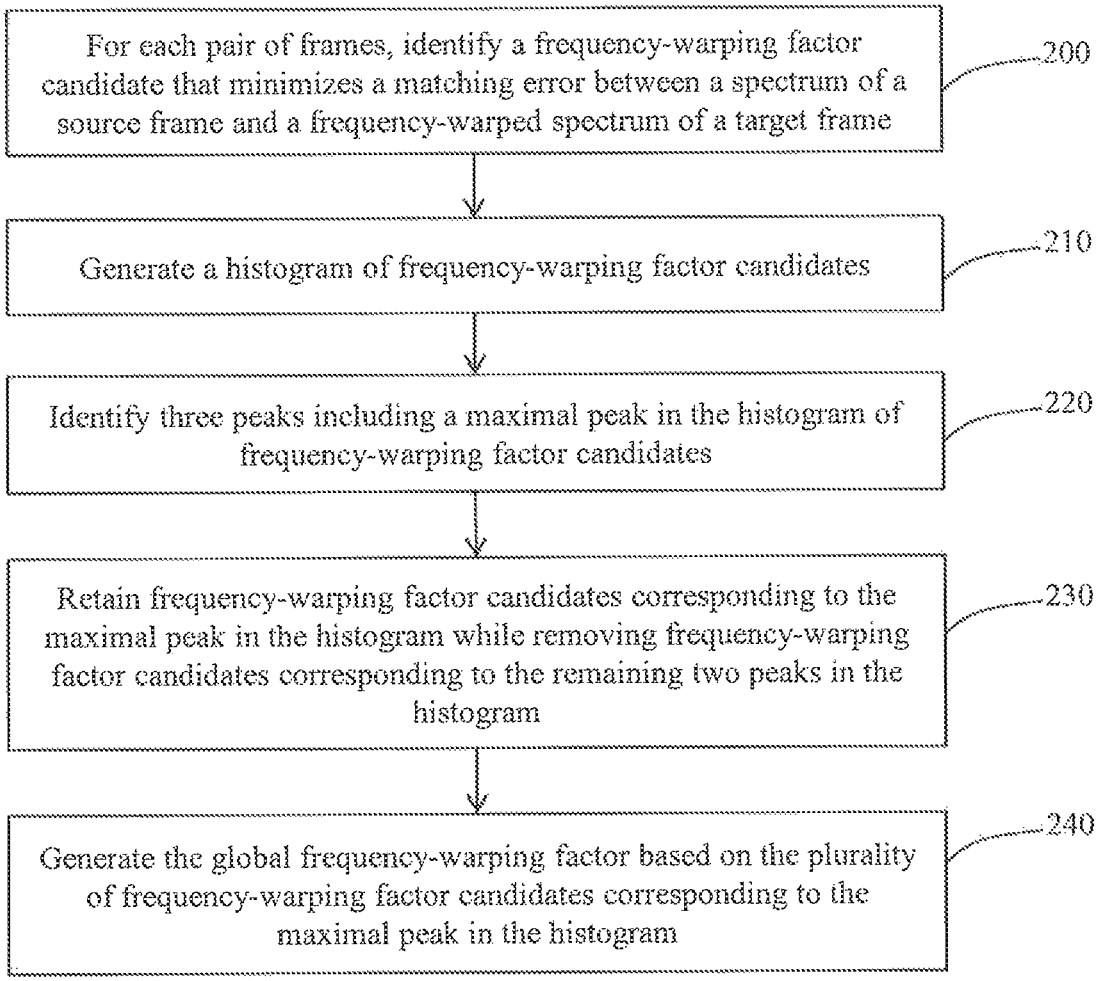
FIG. 2 is a flowchart of the process for pulling frequency-warping factor candidates, in accordance with a preferred embodiment of the present invention.

Illustrated in FIG. 2 is a flowchart of the process for generating the global frequency warping factor from the plurality of frequency-warping factor candidates. The VCS of the preferred embodiment then searches 200 for a value within $\alpha=[\alpha_l, \alpha_u]$ for each pair of feature vectors of same index on $S_{xa}$, and $S_y$ that minimizes $J_k(\alpha)$. The test values, referred to herein as frequency-warping factor candidates, are chosen between $\alpha=0.6$ and 1.3. The frequency-warping factor candidates are then stored as vector $V_a$ and their corresponding spectral errors stored as $V_{J\hat{\alpha}}$.

The VCS then computes a spectral matching error threshold $J_{max}$ as follows:

$$J_{max}=\text{mean}(V_{J\hat{\alpha}})+\text{std}(V_{J\hat{\alpha}})$$

All the elements of $\hat{\alpha}$ of same index as the elements of vector $V_{J\hat{\alpha}}$ that have a value higher than $J_{max}$ are then removed. This procedure effectively removes all the cases denoting a spectral matching error that exceeds the threshold $J_{max}$.

The VCS of the preferred embodiment then computes 210 a histogram $V_{\vec{\alpha}}$ of the frequency-warping factor candidates that satisfy the error threshold. There is one frequency-warping factor candidate for each pair of frames of source and target speech that are both voiced and satisfy the energy threshold. These values are stored along with the centers of each interval of the histogram in vectors $H_{\vec{\alpha}v}$ and $H_{\vec{\alpha}c}$ respectively. In the preferred embodiment, a histogram of size N=10 is used. The motivation of using histogram information to derive the global warping factor is to use heuristics derived from experimentation on the expected characteristics of the probability distribution of $\hat{\alpha}$ in order to obtain a value rather representative of observations contained within a range suggesting higher consistency.

The median value, $\hat{\alpha}_{med}$, of the frequency-warping factor candidates of $V_{\vec{\alpha}}$ is then computed. The bin center position $h_{\hat{\alpha}cm}$ in $H_{\hat{\alpha}c}$ closest to $\hat{\alpha}_{med}$ is also identified. In general, this bin corresponds to a maximal peak is the histogram. The peak generally corresponds to frequency-warping factor candidates that are generated from vowel sounds, which correspond to the acoustic context in which a warping-like phenomenon may better explain the difference between spectra of speech from speakers of different gender. Constants, however, are generally less reliable estimates of the frequency-warping factor candidate and can be removed in the manner described immediately below.

It has been observed that the histogram of the frequency-warping factor candidates sometimes has three peaks 220 including two minor peaks (including clusters of bins) on either side of the maximal peak. The two clusters of bins, resembling side lobes on either side of a main peak, are then identified and removed from consideration of the global frequency-warping factor computation. These side lobes are separated 230 from the maximal peak by a local minima. The VCS first finds the bin centers $h_{\hat{\alpha}l}$ and $h_{\hat{\alpha}r}$ in $h_{\alpha c}$ that denote the positions of the first minima in $h_{\alpha v}$ found in the neighborhood of $h_{\hat{\alpha}cm}$ (e.g. $h_{\hat{\alpha}l}\leq h_{\hat{\alpha}cm}\geq h_{\hat{\alpha}r}$). If any of the local minima represented by $h_{\hat{\alpha}l}$ $h_{\hat{\alpha}r}$ are located right next to the maximal peak the computation of the histogram with higher resolution (e.g. size 20) and further steps are repeated.

The elements of $V_{\vec{\alpha}}$ out of the bounds denoted by $h_{\hat{\alpha}l}$, and $h_{\hat{\alpha}r}$ (e.g. $V_{\vec{\alpha}}<h_{\vec{\alpha}l}$ at and $V_{\hat{\alpha}}>h_{\hat{\alpha}r}$) are then removed, thereby removing spurious estimates of the frequency-warping factor candidates. That is, the frequency-warping factor candidates that fall within the histogram bins outside of the main histogram peak are excluded from the calculation of the global frequency-warping factor. These elements result in poor alignment of the main spectral features denoted between $Ux_{f\alpha(\omega),k}$ and $Uy_{\omega,k}$, and are therefore treated as spurious data.

Thereafter, the histogram of frequency-warping factor candidates is recomputed but at high bin resolution (e.g. histogram of size 20) to preserve a minimum precision on the probabilistic distribution of $V_{\vec{\alpha}}$ independently of the length of the side lobes removed at the previous step.

The VCS then identifies the index $i_{max}$ of the element denoting the maxima of $H_{\hat{\alpha}v}$. This bin corresponds to a peak in the high-resolution histogram, which generally includes the optimum estimate 240 of the global frequency-warping factor. If this bin is the only prominent bin, the data in this bin alone is used to compute the global frequency-warping factor. The bin is considered the prominent bin if the next-highest bin is less than a given threshold, preferably ⅔ the height of the highest bin.

If, however, the number of prominent bins centered in vector $V_{\vec{\alpha}}$ is two or more, the global frequency-warping factor may be computed based on a plurality of bins that exceed a given threshold. Here, the set of prominent bins includes all bins that that exceed a predetermined threshold, preferably ⅔ the height of the maximum bin. In this case, the global frequency-warping factor $\hat{\alpha}_{opt}$ is computed as a weighted average as follows.

$$\hat{\alpha}_{ave}=\frac{1}{\Sigma H_{\hat{\alpha}v}(I_{\hat{\alpha}max})}\sum H_{\hat{\alpha}c}(I_{\hat{\alpha}max})H_{\hat{\alpha}v}(I_{\hat{\alpha}max})$$

where $H_{\hat{\alpha}v}(I_{\hat{\alpha}max})$ and $H_{\hat{\alpha}c}(I_{\hat{\alpha}max})$ denote the elements of vectors $H_{\hat{\alpha}v}$ and $H_{\hat{\alpha}c}$ at the positions $I_{\hat{\alpha}max}$. The value $\hat{\alpha}_{ave}$ represents the estimation of the global frequency-warping function factor.

Figure 3:
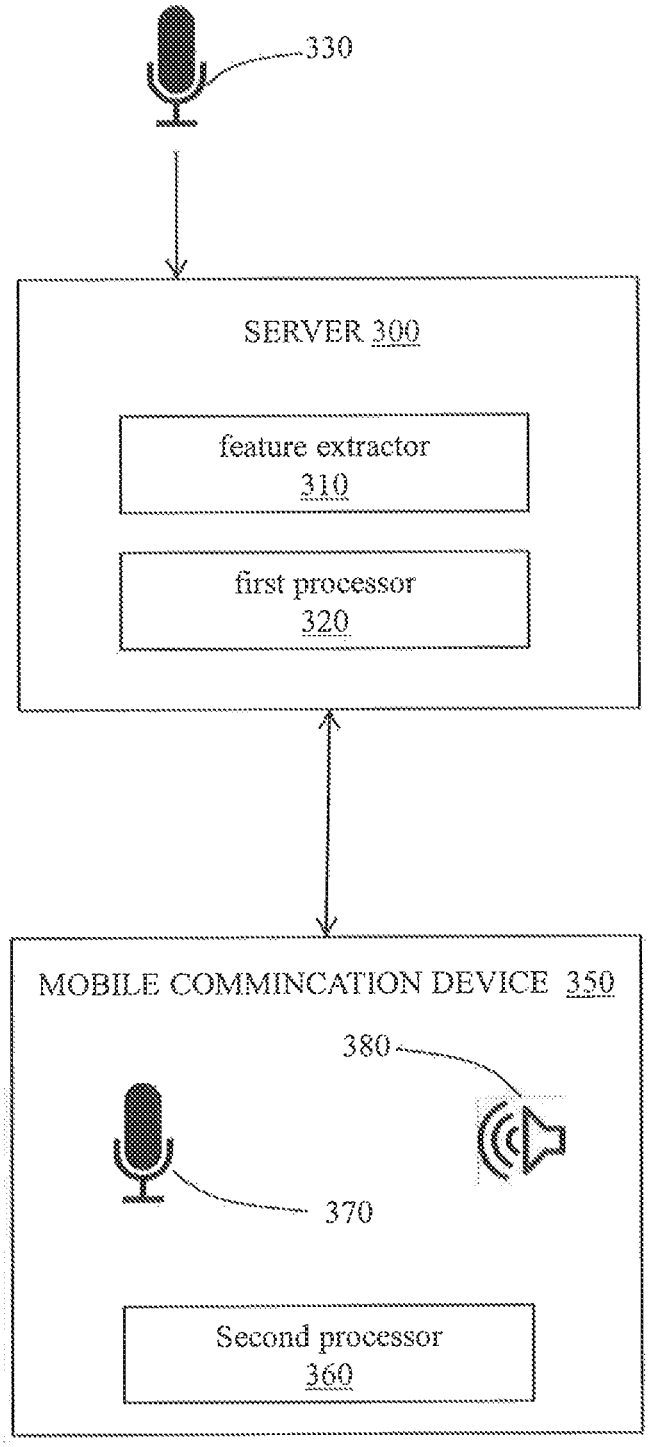
FIG. 3 is a functional block diagram for converting a source voice to a target voice, in accordance with a preferred embodiment of the present invention.

Illustrated in FIG. 3 is a functional block diagram of the Voice Conversion System (VCS) in the preferred embodiment. The VCS generally includes a microphone 330 for recording source speech data and target speech data. The speech data is transmitted to a server 300 which then identifies Mel Cepstral features (or other spectral envelope representation) using a feature extractor 310. Based on these features, the first processor 320 computes a plurality of frequency-warping factor candidates in the manner described above. A single global frequency warping factor is then computed from the best matching voiced frames of speech and target data, wherein those frames typically consist of voiced data corresponding to the pronunciation of vowel sounds.

After the generation of the global frequency warping factor, a computing device or mobile phone 350, for example, may be used to convert source speech acquired with the phone's microphone 370 into target speech using an internal processor 360 or server 300. Once assembled into a waveform, the target speech may be played to the user via the speaker system 380 on the mobile phone 350. In this manner, the user may generate audio and then hear their speech read by a target speaker of their selection.

One or more embodiments of the present invention may be implemented with one or more computer readable media, wherein each medium may be configured to include thereon data or computer executable instructions for manipulating data. The computer executable instructions include data structures, objects, programs, routines, or other program modules that may be accessed by a processing system, such as one associated with a general-purpose computer or processor capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. Examples of mass storage devices incorporating computer readable media include hard disk drives, magnetic disk drives, tape drives, optical disk drives, and solid state memory chips, for example. The term processor as used herein refers to a number of processing devices including personal computing devices, servers, general purpose computers, special purpose computers, application-specific integrated circuit (ASIC), and digital/analog circuits with discrete components, for example.

Although the description above contains many specifications, these should not be construed as limiting the scope of the invention but as merely providing illustrations of some of the presently preferred embodiments of this invention.

Therefore, the invention has been disclosed by way of example and not limitation, and reference should be made to the following claims to determine the scope of the present invention.

We claim:

1. A method of converting a source voice to a target voice, the method comprises:

recording source voice data and target voice data, wherein the source voice data comprises a first plurality of frames and the target voice data comprises a second plurality of frames;

extracting spectral envelope features from the first plurality of frames and second plurality of frames;

time-aligning pairs of frames based on the extracted spectral envelope features, each pair of frames comprising one of the first plurality of frames and one of the second plurality of frames;

converting each pair of frames into a frequency domain;

generating, a plurality of frequency-warping factor candidates, wherein each of the plurality of frequency-warping factor candidates is associated with one of the pairs of frames;

generating a single global frequency-warping factor from the plurality of frequency-warping factor candidates;

acquiring source speech;

converting the source speech to target speech based on the global frequency-warping factor;

generating a waveform comprising the target speech; and playing the waveform comprising the target speech to a user;

wherein generating a plurality of frequency-warping factor candidates comprises for each pair of frames, identifying a frequency-warping factor candidate that minimizes a matching error between a spectrum of a source frame and a frequency-warped spectrum of a target frame;

wherein generating a single global frequency-warping factor from the plurality of frequency-warping factor candidates comprises generating a histogram of frequency-warping factor candidates;

wherein generating a single global frequency-warping from the plurality of frequency-warping factor candidates further comprises identifying three peaks including a maximal peak in the histogram of frequency-warping factor candidates;

wherein generating a single global frequency-warping factor from the plurality of frequency-warping factor candidates further comprises:

a) retaining frequency-warping factor candidates corresponding to the maximal peak in the histogram;

b) removing frequency-warping factor candidates corresponding to the remaining two peaks in the histogram; and c) generating the global frequency-warping factor based on the plurality of frequency-warping factor candidates corresponding to the maximal peak in the histogram.

2. The method of claim 1, wherein the spectral envelope features are Mel-Cepstral features.

3. The method of claim 1, wherein time-aligning pairs of frames comprises dynamic time alignment.

4. The method of claim 1, wherein time-aligning pairs of frames based on the extracted spectral envelope features comprises:

retaining time-aligning pairs of frames where both frames of the pair comprise voiced data; and removing time-aligning pairs of frames where both frames of the pair fail to comprise voiced data.

5. The method of claim 1, wherein time-aligning pairs of frames based on the extracted spectral envelope features further comprises:

determine an energy associated with each pair of time-aligning pairs of frames;

retaining time-aligning pairs of frames where the determined energy satisfies a predetermined threshold; and removing time-aligning pairs of frames where the determined energy fails to satisfy the predetermined threshold.

6. A system for converting a source voice to a target voice, the system comprises:

a first microphone for recording source voice data, wherein the source voice data comprises a first plurality of frames;

a second microphone for recording target voice data, wherein the target voice data comprises a second plurality of frames;

a feature extractor for extracting spectral envelope features from the first plurality of frames and second plurality of frames;

a first processor for:

a) time-aligning pairs of frames based on the extracted spectral envelope features, each pair of frames comprising one of the first plurality of frames and one of the second plurality of frames;

b) converting each pair of frames into a frequency domain;

c) generating a plurality of frequency-warping factor candidates, wherein each of the plurality of frequency-warping factor candidates is associated with one of the pairs of frames;

d) generating a single global frequency-warping factor from the plurality of frequency-warping factor candidates;

wherein the first microphone is further configured to acquire source speech;

a second processor is configured to:

a) convert the source speech to target speech based on the global frequency-warping factor, b) generate a waveform comprising the target speech; and a speaker for playing the waveform comprising the target speech to a user;

wherein generating a plurality of frequency-warping factor candidates comprises, for each pair of frames, identifying a frequency-warping factor candidate that minimizes a matching error between a spectrum of a source frame and a frequency-warped spectrum of a target frame;

wherein generating a single global frequency-warping factor from the plurality of frequency-warping factor candidates comprises generating a histogram of frequency-warping factor candidates;

wherein generating a single global frequency-warping factor from the plurality of frequency-warping factor candidates further comprises identifying three peaks including a maximal peak in the histogram of frequency-warping factor candidates;

wherein generating a single global frequency-warping factor from the plurality of frequency-warping factor candidates further comprises:

a) retaining frequency-warping factor candidates corresponding to the maximal peak in the histogram;

b) removing frequency-warning factor candidates corresponding to the remaining two peaks in the histogram; and c) generating the global frequency-warping factor based on the plurality of frequency-warping factor candidates corresponding to the maximal peak in the histogram.

* * * * *